US012319452B1

(12) United States Patent
Cortes

(10) Patent No.: US 12,319,452 B1
(45) Date of Patent: Jun. 3, 2025

(54) PLASTIC WRAP SECURING BRACKET

(71) Applicant: Oscar Cortes, Adelanto, CA (US)

(72) Inventor: Oscar Cortes, Adelanto, CA (US)

( * ) Notice: Subject to any disclaimer, the term of this patent is extended or adjusted under 35 U.S.C. 154(b) by 0 days.

(21) Appl. No.: 18/428,948

(22) Filed: Jan. 31, 2024

(51) Int. Cl.
*B65B 13/34* (2006.01)
*B65B 67/08* (2006.01)
*B65D 19/38* (2006.01)

(52) U.S. Cl.
CPC ..... *B65B 13/34* (2013.01); *B65B 67/085* (2013.01); *B65D 19/38* (2013.01)

(58) Field of Classification Search
CPC ..... F16B 5/0692; F16B 2/2265; F16B 2/22; B65D 19/38; B65B 67/085; B65B 13/34
See application file for complete search history.

(56) References Cited

U.S. PATENT DOCUMENTS 3,754,636 A 8/1973 Boy
3,836,106 A 9/1974 Gray
4,571,779 A 2/1986 Koerschner
D448,987 S 10/2001 Davis
6,450,515 B1 * 9/2002 Guth ..... B60B 33/0002 280/47.32
D608,189 S 1/2010 Jackson
2003/0136085 A1 7/2003 Hendricks
2010/0101131 A1 4/2010 Lipczynski
2010/0300332 A1 * 12/2010 Hayman ..... F16B 2/241 108/51.11
2017/0043904 A1 2/2017 Nelson

FOREIGN PATENT DOCUMENTS

GB 2226077 6/1990

* cited by examiner

*Primary Examiner* — Daniel Jeremy Leeds

(57) ABSTRACT

A plastic wrap securing bracket includes a first leg plate, a second leg plate, a back plate, and an elongated prong. The bracket has a substantially U shape and is designed to grip an end portion of a runner or block of a wood pallet. The elongated prong is designed to receive and secure a bunched-up end portion of a roll of plastic wrap therein to permit a single user to unroll the roll of plastic wrap around articles on a wood pallet using both hands.

17 Claims, 11 Drawing Sheets

PLASTIC WRAP SECURING BRACKET

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to securing or retaining brackets and more particularly pertains to a new plastic wrap securing bracket for holding an end of plastic wrap in place an end portion of a runner or block of a wood pallet to permit the user to wrap the products or articles on the pallet. In general, products stacked on wood pallets, such as boxes of food, appliances, or other consumer or commercial items, are usually wrapped in a layer or layers of plastic wrap or shrink wrap. In order to do so, a worker often starts near the bottom or the top and walks around the stack of goods while unrolling a large roll of plastic wrap material. The rolls are quite large and require two hands, such as one would do with a rolling pin or similar, in order to unroll them. However, it is challenging, especially for a solo worker, to get the wrapping the process started because the initial end portion of the roll is of course not secured in any manner. The end of the roll could be jammed under the pallet or between articles, but this is not consistently effective and sometimes not possible with very heavy and/or closely packed articles. Even having another worker hold the end is not very efficient.

(2) Description of Related Art Including Information Disclosed Under 37 CFR 1.97 and 1.98

The prior art relates to securing or retaining brackets which are used to hold different items in place. The prior art, as best understood, does not disclose a U-shaped bracket structure that is to be attached onto the end of a runner or block of a wood pallet having integral teeth on the inner face of the bracket for securing to a wood pallet, and a single elongated prong on an external face of the bracket for attaching the tail of a pallet wrap.

BRIEF SUMMARY OF THE INVENTION

An embodiment of the disclosure meets the needs presented above in a plastic wrap securing bracket generally comprising a first leg plate, a second leg plate, a back plate, and an elongated prong. The back plate is positioned essentially perpendicular to and connecting the first leg plate and the second leg plate in a substantially U shape. The first leg plate includes a first internal face and a first external face. The second leg plate includes a second internal face and a second external face. The first internal face and the second internal face is positioned facing toward one another. The first leg plate and the second leg plate is designed to grip an end portion of a runner or block of a wood pallet with the first internal face and the second internal face. The first leg plate includes an elongated prong positioned at an angle and projecting from the first external face. The elongated prong includes a fixed end connected to the first external face and a free end positioned adjacent the back plate and a distance from the first external face to form a tapered securing space designed to receive and secure a bunched-up end portion of a roll of plastic wrap therein to permit a user to unroll the roll of plastic wrap around articles on a wood pallet. This design advantageously allows a single worker to secure the end of the plastic wrap and then unroll the roll of plastic wrap about the articles on a wood pallet using both hands.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
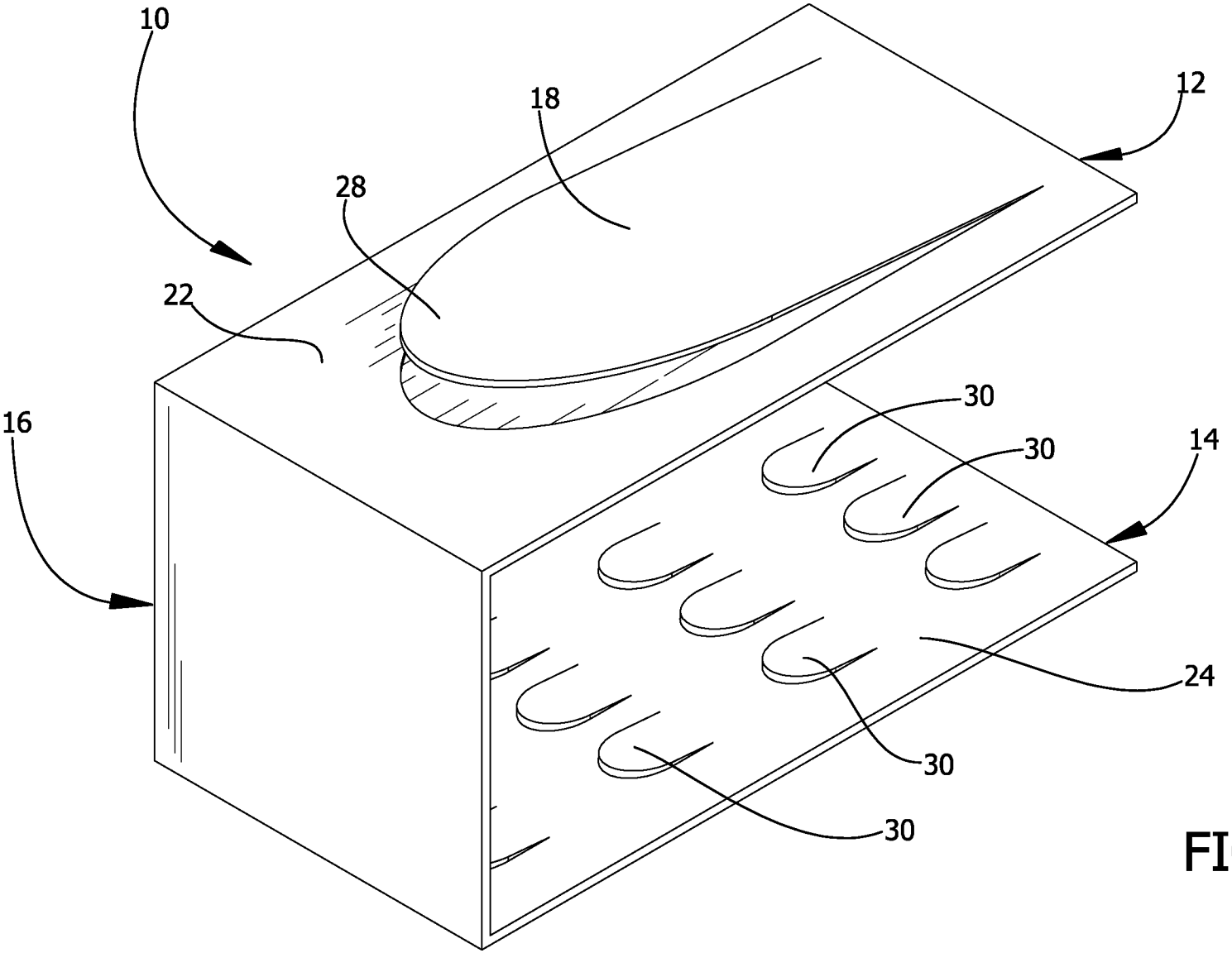
FIG. 1 is a front perspective view of a plastic wrap securing bracket according to an embodiment of the disclosure.
Figure 2:
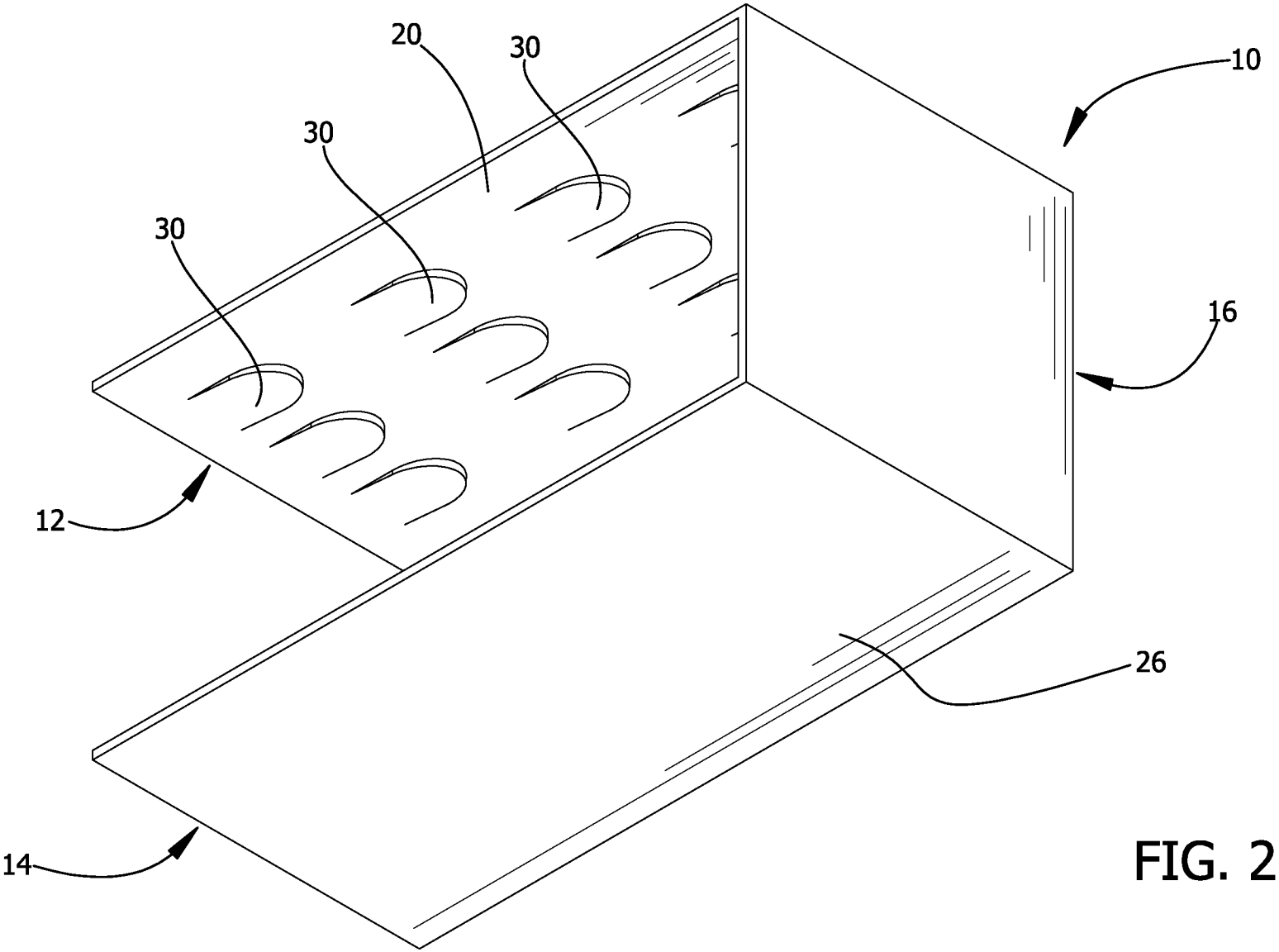
FIG. 2 is a rear perspective view of an embodiment of the disclosure.
Figure 3:
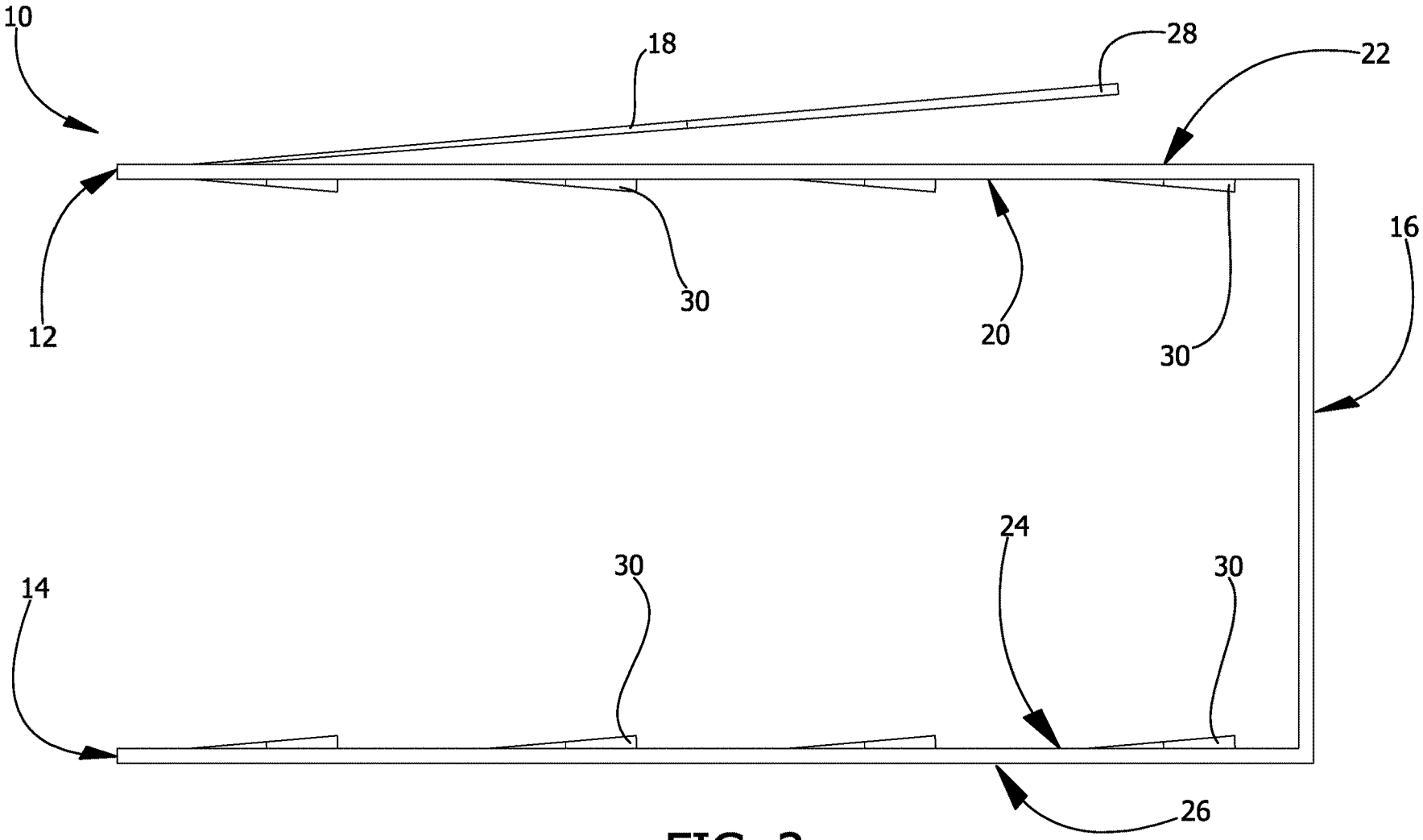
FIG. 3 is a side view of an embodiment of the disclosure.
Figure 4:
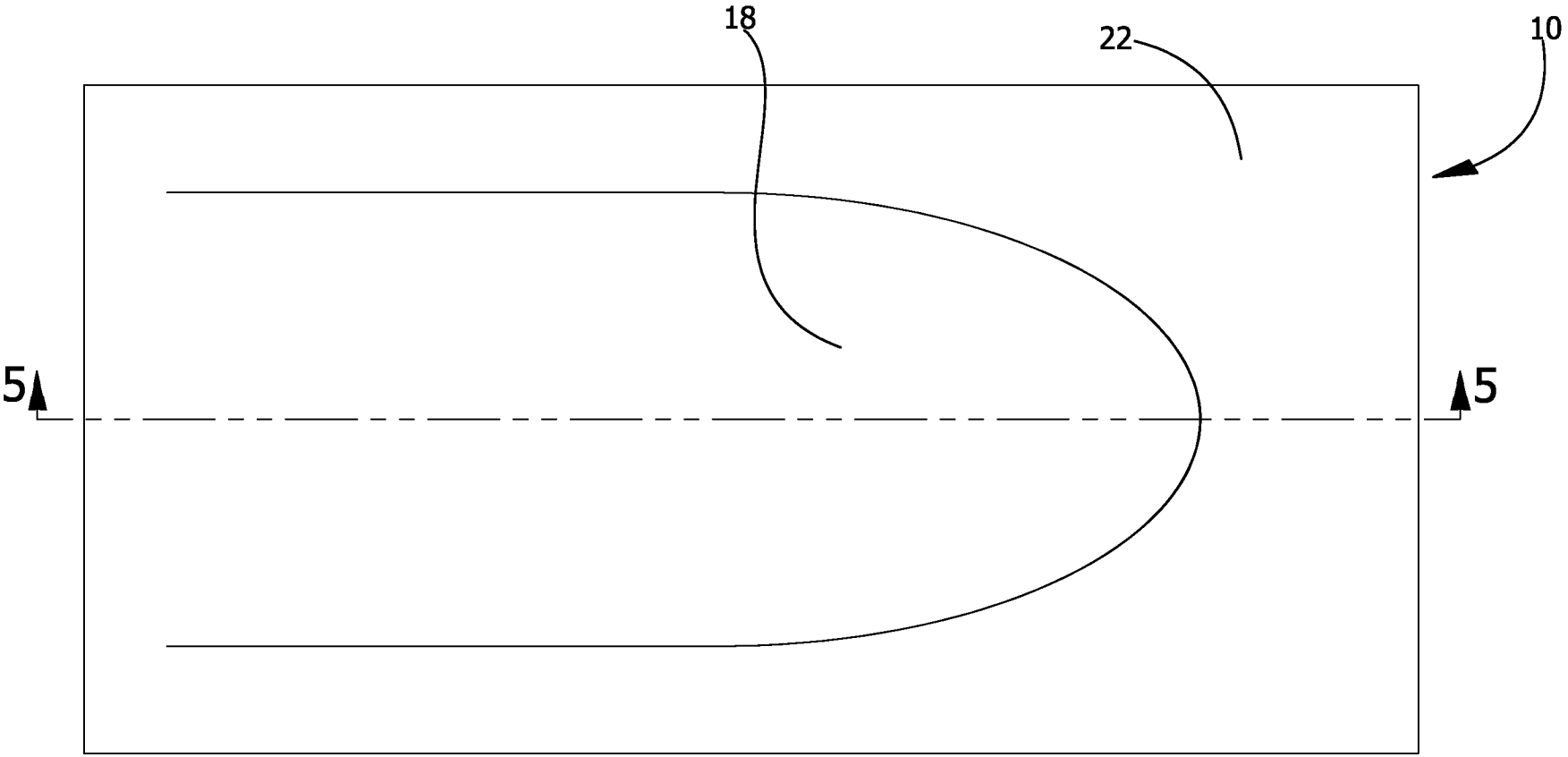
FIG. 4 is a top view of an embodiment of the disclosure.
Figure 5:
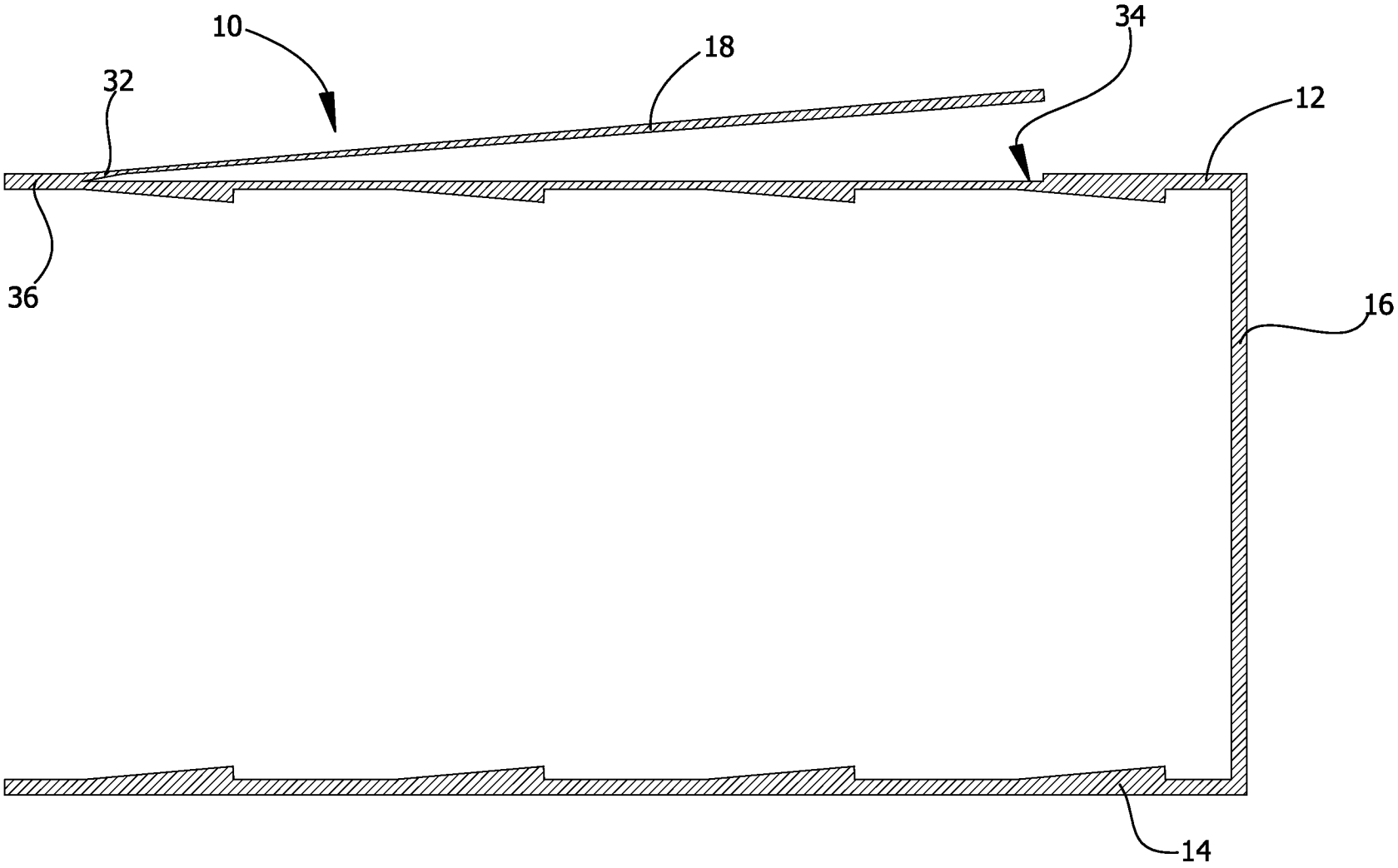
FIG. 5 is a cross-sectional view of an embodiment of the disclosure.

With reference now to the drawings, and in particular to FIGS. 1 through 11 thereof, a new plastic wrap securing bracket embodying the principles and concepts of an embodiment of the disclosure and generally designated by the reference numeral 10 will be described.

As best illustrated in FIGS. 1 through 11, the plastic wrap securing bracket 10 generally includes a first leg plate 12, a second leg plate 14, a back plate 16, and an elongated prong 18. The back plate 16 is positioned to connect the first leg plate 12 and the second leg plate 14 in a substantially U shape. The first leg plate 12 includes a first internal face 20 and a first external face 22. The second leg plate 14 includes a second internal face 24 and a second external face 26. The first internal face 20 and the second internal face 24 are positioned facing toward one another. The first leg plate 12 and the second leg plate 14 are designed to grip an end portion of a runner or block 52 of a wood pallet 50 with the first internal face 20 and the second internal face 24. The first leg plate 12 includes an elongated prong 18 positioned at an angle and projecting from the first external face 22. The elongated prong 18 includes a fixed end connected to the first external face 22 and a free end 28 positioned adjacent the back plate 16 and a distance from the first external face 22 to form a tapered securing space designed to receive and secure a bunched-up end portion 42 of a roll of plastic wrap 40 therein to permit a user to unroll the roll of plastic wrap 40 around articles 44 on a wood pallet 50.

Figure 8:
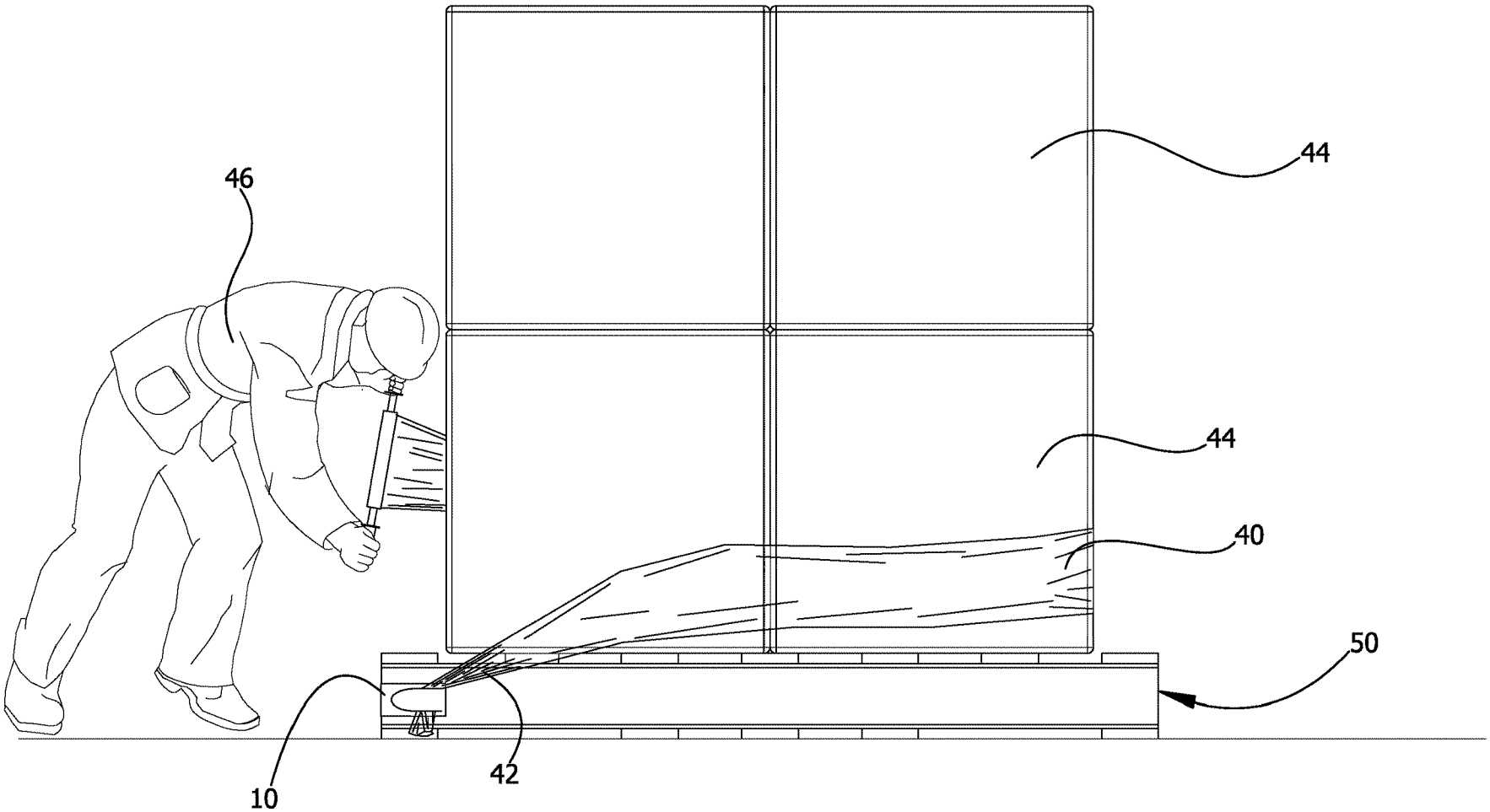
FIG. 8 is a side view of an embodiment of the disclosure in use.

In accordance with at least one possible embodiment, the second leg plate 14 includes gripping teeth 30 positioned to project out of the second internal face 24. In accordance with at least one possible embodiment, the first leg plate 12 includes gripping teeth 30 positioned to project out of the first internal face 20. It is possible, in accordance with at least one possible embodiment shown in FIG. 11, for the gripping teeth 30 to be completely omitted. In this embodiment, the first leg plate 12 and the second leg plate 14 may be slightly angled inwardly such that the plastic wrap securing bracket 10 grips the runner 52 with a clamping force. Since the plastic wrap 40, as shown in FIG. 8, is pulled in a direction such that the plastic wrap 40 tugs or pulls the plastic wrap securing bracket 10 so as to only tighten the connection, the gripping teeth 30 may not be needed to prevent inadvertent dislodging in the opposite direction. Such a design would make it easier to remove the plastic wrap securing bracket 10 once the plastic wrap 40 is fully wrapped or after transport. In this manner one plastic wrap securing bracket 10 could be used on multiple pallets 50. The embodiments that include the gripping teeth 30 may be designed to be removable as well, or such that they essentially cannot be removed after installation so that the plastic wrap securing bracket 10 is always present for the next user of the wood pallet 50.

Figure 6:
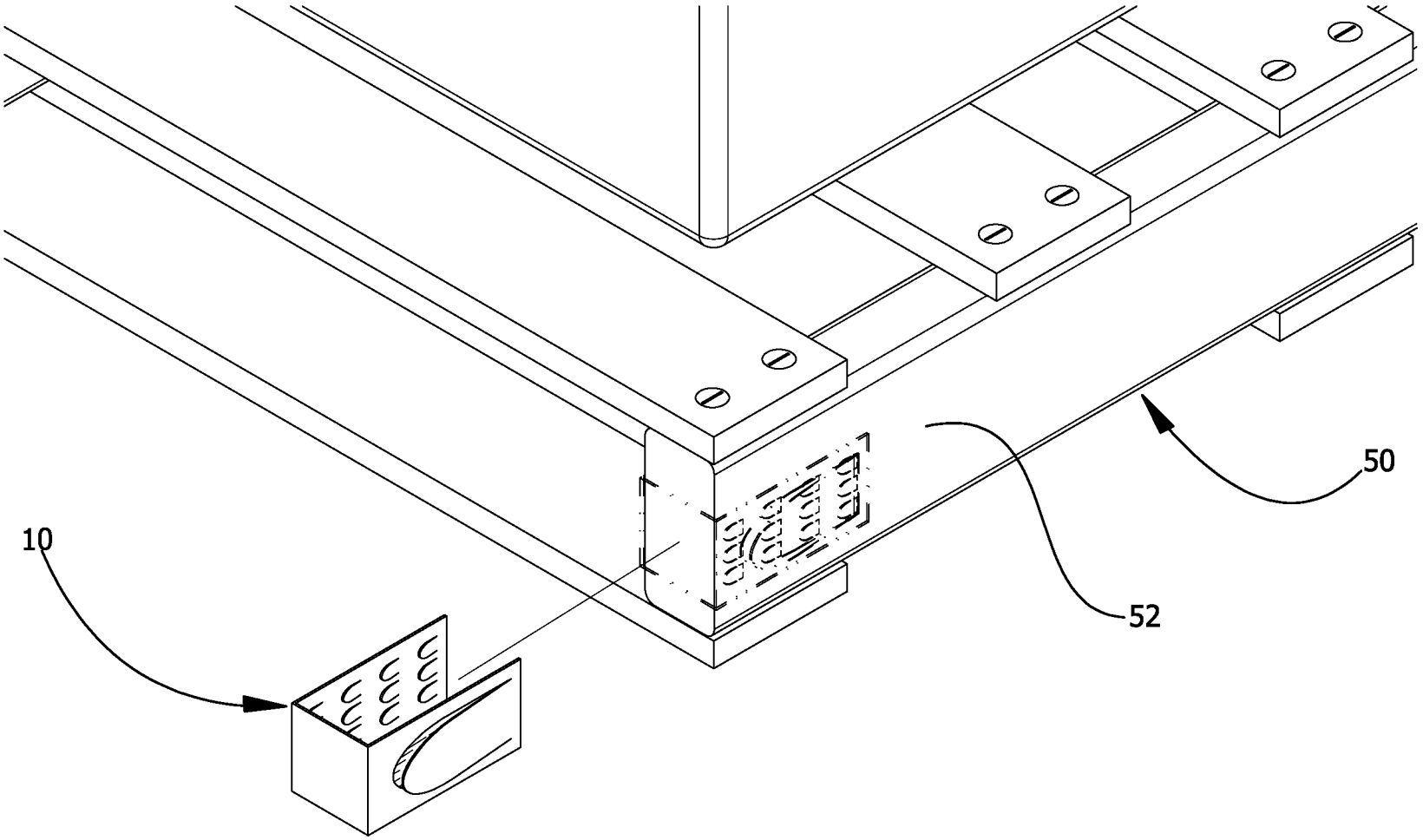
FIG. 6 is a front perspective view of an embodiment of the disclosure in use.
Figure 7:
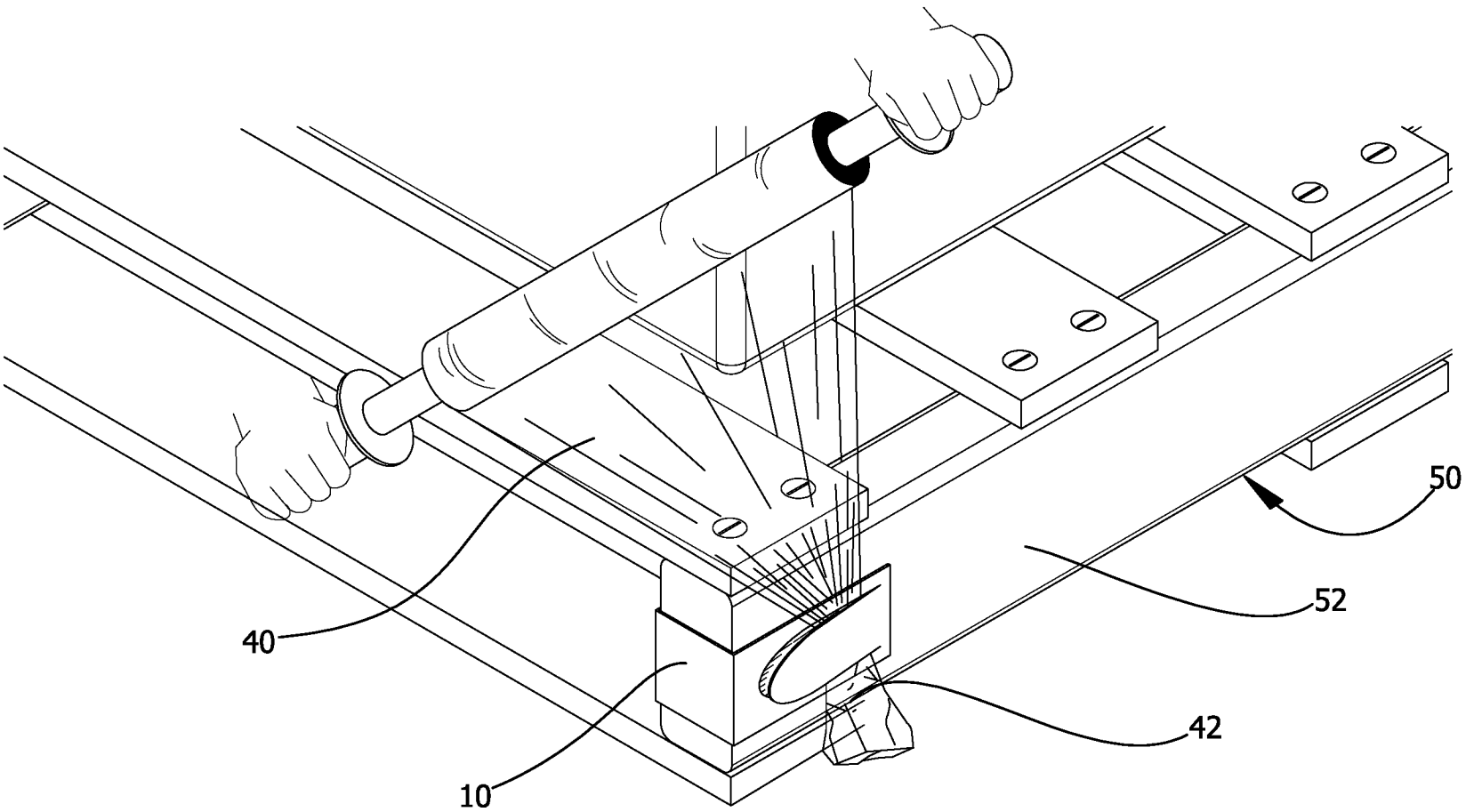
FIG. 7 is a front perspective view of an embodiment of the disclosure in use.

In accordance with at least one possible embodiment, the free end 28 of the elongated prong 18 is rounded to facilitate insertion of plastic wrap 40 into the tapered securing space without snagging or tearing. In accordance with at least one possible embodiment, as best seen in FIGS. 6 and 7, the back plate 16 has a width essentially similar to the width of an end of a runner or block 52 of a wood pallet 50 to promote tight fit and gripping by the first leg plate 12 and the second leg plate 14. In accordance with at least one possible embodiment, each of the back plate 16, the first leg plate 12, and the second leg plate 14 are integrally formed in a single metal structure.

Figure 9:
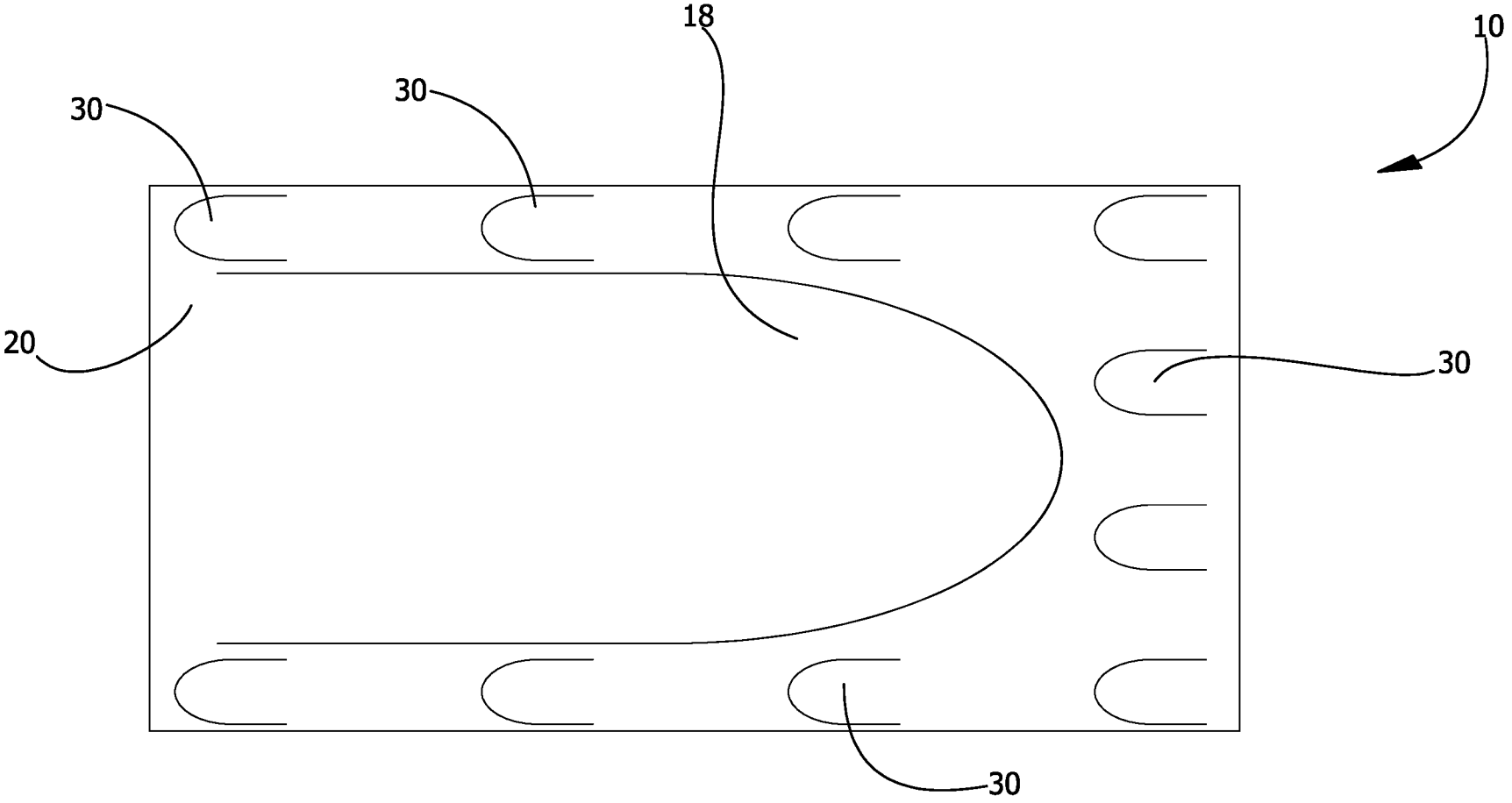
FIG. 9 is a view of a portion an embodiment of the disclosure.
Figure 10:
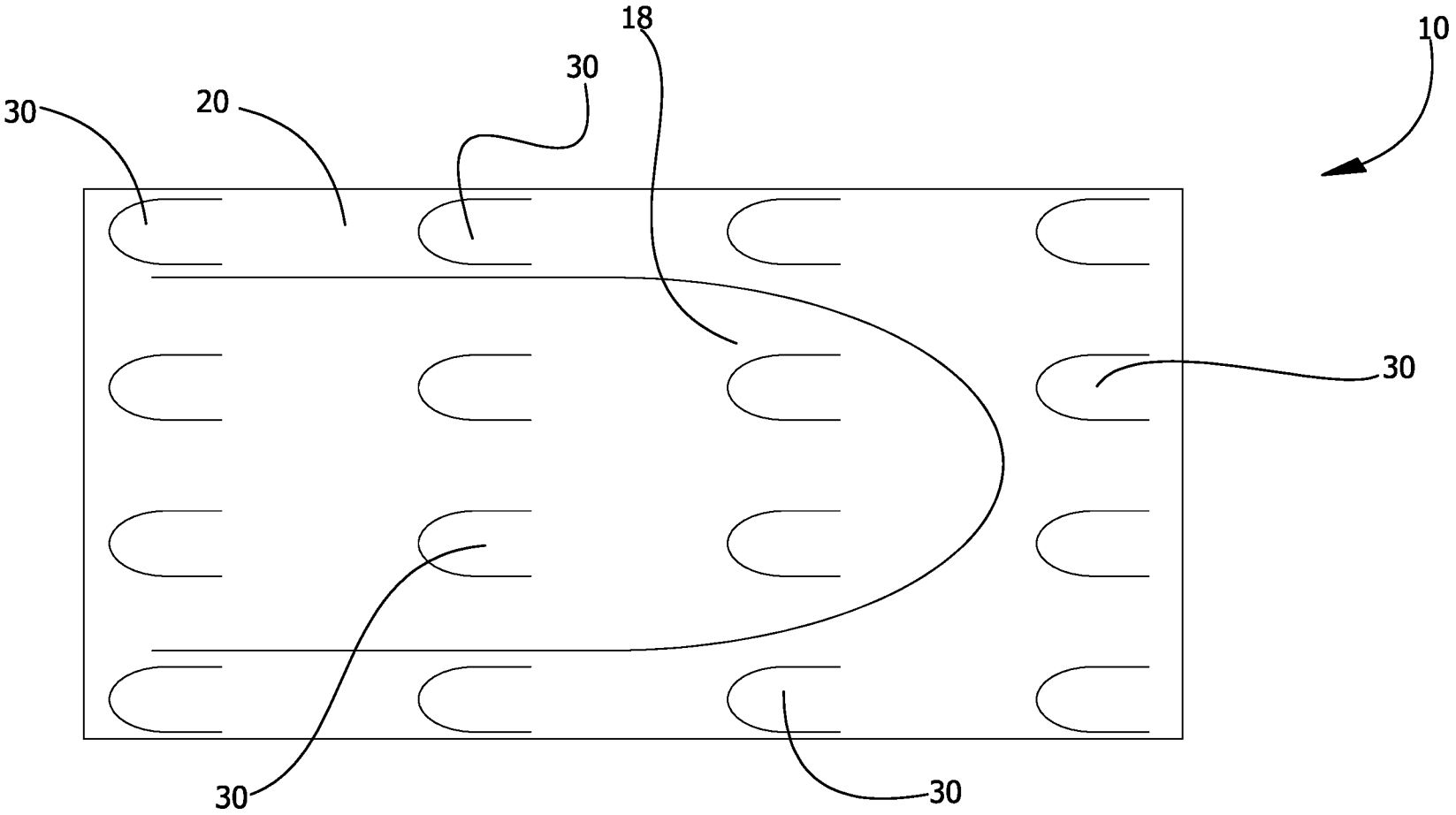
FIG. 10 is a view of a portion an embodiment of the disclosure.
Figure 11:
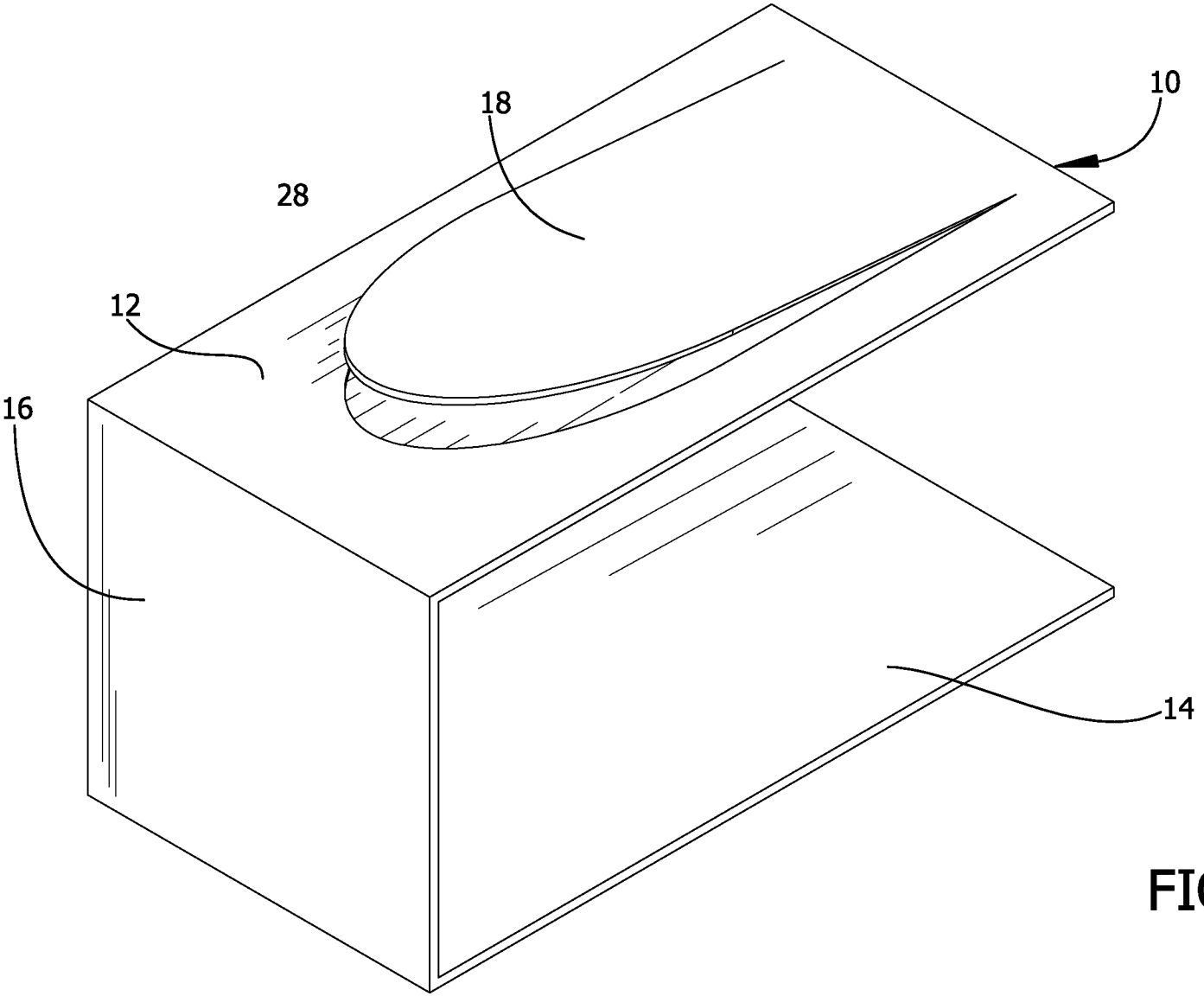
FIG. 11 is a front perspective view of an embodiment of the disclosure.

In accordance with at least one possible embodiment shown in FIGS. 1 through 5, the elongated prong 18 is formed from a first layer portion 32 of the first leg plate 12 and projects above a recess 34 therein and a second layer portion 36. The gripping teeth 30 are positioned spaced apart across the first internal face 20 including on the second layer portion 36. In accordance with at least one possible embodiment, the first leg plate 12 is a single layer and the elongated prong 18 is formed or cut out from the first leg plate 12 and projects above the resulting opening therein. As shown in FIG. 9, the gripping teeth 30 are positioned spaced apart across the first internal face 20 about the opening. Alternatively, as shown in FIG. 10, a plurality of the gripping teeth 30 are positioned spaced apart on the interior surface of the elongated prong 18 to provide additional gripping and securing of the plastic wrap 40. This would also simplify manufacture as the gripping teeth 30 could be formed first and then the elongated prong 18 cut and bent. In accordance with at least one possible embodiment, the gripping teeth 30 are not formed projections, but rather are smaller prongs like the elongated prong 18 cut out of the first leg plate 12 and/or the second leg plate 14 and bent inwardly, much like the prongs or cutting projections of a grater device.

To use the plastic wrap securing bracket 10, a user or worker 46 first aligns the first leg plate 12 and the second leg plate 14 with the sides of an end portion of a runner or block 52 of a wood pallet 50. The user 46 then pushes the back plate 16 until the back plate 16 is in contact with an end face of the runner or block 52 and the first internal face 20 and the second internal face 24 are in gripping contact with the sides of the end portion of the runner or block 52. The user 46 then can unroll an end portion 42 of plastic wrap 40 from a roll of the plastic wrap 40. The user 46 then pushes the end portion 42 of the plastic wrap 40 into the tapered securing space under the elongated prong 18 and bunches up the end portion 42 and wedges the plastic wrap 40 between the elongated prong 18 and the first external face 22 in a secure manner. The user 46 then is free to use both hands to unroll more plastic wrap 40 by pulling the roll of the plastic wrap 40 in a direction away from the free end 28 of the elongated prong 18 and finally wraps articles 44 on the wood pallet 50.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A plastic wrap securing bracket comprising:

a first leg plate and a second leg plate;

a back plate being disposed to connect said first leg plate and said second leg plate to form a substantially U shape;

said first leg plate comprising a first internal face and a first external face;

said second leg plate comprising a second internal face and a second external face;

said first internal face and said second internal face being disposed facing toward one another;

said first leg plate and said second leg plate being configured to grip an end portion of a runner or block of a wood pallet with said first internal face and said second internal face;

said first leg plate comprising an elongated prong disposed at an angle and projecting from said first external face; and said elongated prong comprising a fixed end connected to said first external face and a free end disposed adjacent said back plate and a distance from said first external face to form a tapered securing space configured to receive and secure a bunched-up end portion of a roll of plastic wrap therein to permit a user to unroll the roll of plastic wrap around articles on a wood pallet.

2. The plastic wrap securing bracket of claim 1, wherein said second leg plate comprises gripping teeth disposed to project out of said second internal face.

3. The plastic wrap securing bracket of claim 2, wherein said first leg plate comprises gripping teeth disposed to project out of said first internal face.

4. The plastic wrap securing bracket of claim 3, wherein said free end of said elongated prong is rounded to facilitate insertion of plastic wrap into said tapered securing space without snagging or tearing.

5. The plastic wrap securing bracket of claim 4, wherein said back plate has a width essentially similar to the width of an end of a runner or block of a wood pallet to promote tight fit and gripping by said first leg plate and said second leg plate.

6. The plastic wrap securing bracket of claim 5, wherein each of said back plate, said first leg plate, and said second leg plate are integrally formed in a single metal structure.

7. The plastic wrap securing bracket of claim 6, wherein:

said elongated prong is formed from a first layer portion of said first leg plate and projects above a recess therein and a second layer portion; and said gripping teeth are disposed spaced apart across said first internal face including on said second layer portion.

8. The plastic wrap securing bracket of claim 6, wherein:

said elongated prong is formed from said first leg plate and projects above an opening therein; and said gripping teeth are disposed spaced apart across said first internal face about said opening.

9. The plastic wrap securing bracket of claim 6, wherein:

said elongated prong is formed from said first leg plate and projects above an opening therein;

said gripping teeth are disposed spaced apart across said first internal face about said opening; and a plurality of said gripping teeth are disposed spaced apart on the interior surface of said elongated prong to provide additional gripping and securing of said plastic wrap.

10. The plastic wrap securing bracket of claim 1, wherein said first leg plate comprises gripping teeth disposed to project out of said first internal face.

11. The plastic wrap securing bracket of claim 1, wherein said free end of said elongated prong is rounded to facilitate insertion of plastic wrap into said tapered securing space without snagging or tearing.

12. The plastic wrap securing bracket of claim 1, wherein said back plate has a width essentially similar to the width of an end of a runner or block of a wood pallet to promote tight fit and gripping by said first leg plate and said second leg plate.

13. The plastic wrap securing bracket of claim 1, wherein each of said back plate, said first leg plate, and said second leg plate are integrally formed in a single metal structure.

14. The plastic wrap securing bracket of claim 2, wherein:

said elongated prong is formed from a first layer portion of said first leg plate and projects above a recess therein and a second layer portion; and said gripping teeth are disposed spaced apart across said first internal face including on said second layer portion.

15. The plastic wrap securing bracket of claim 2, wherein:

said elongated prong is formed from said first leg plate and projects above an opening therein; and said gripping teeth are disposed spaced apart across said first internal face about said opening.

16. The plastic wrap securing bracket of claim 2, wherein:

said elongated prong is formed from said first leg plate and projects above an opening therein;

said gripping teeth are disposed spaced apart across said first internal face about said opening; and a plurality of said gripping teeth are disposed spaced apart on the interior surface of said elongated prong to provide additional gripping and securing of said plastic wrap.

17. A method of using the plastic wrap securing bracket of claim 1, comprising the steps of:

aligning said first leg plate and said second leg plate with the sides of an end portion of a runner or block of a wood pallet;

pushing said back plate until said back plate is in contact with an end face of the runner or block and said first internal face and said second internal face are in gripping contact with the sides of the end portion of the runner or block;

unrolling an end portion of plastic wrap from a roll of the plastic wrap;

pushing the end portion of the plastic wrap into said tapered securing space under said elongated prong and bunching up the end portion and wedging the plastic wrap between said elongated prong and said first external face in a secure manner; and unrolling more plastic wrap by pulling the roll of the plastic wrap in a direction away from said free end of said elongated prong and wrapping articles on the wood pallet.

* * * * *